United States Patent [19]

Hanes

[11] 4,308,995

[45] Jan. 5, 1982

[54] CARTON END CLOSURE WITH INTEGRAL HANDLE

[75] Inventor: Harry R. Hanes, Ramsey, N.J.

[73] Assignee: Federal Paper Board Company, Inc., Montvale, N.J.

[21] Appl. No.: 133,912

[22] Filed: Mar. 25, 1980

[51] Int. Cl.[3] ..... B65D 5/46; B65D 25/28

[52] U.S. Cl. ..... 229/52 B; 206/141

[58] Field of Search ..... 229/52 B, 141

[56] References Cited

U.S. PATENT DOCUMENTS

| | | | |
|---|---|---|---|
| 2,916,195 | 12/1959 | Gatward | 229/52 B |
| 3,776,108 | 12/1973 | Nock | 229/52 B X |
| 4,017,019 | 4/1977 | Booth | 229/52 B X |
| 4,134,534 | 1/1979 | Scott et al. | 229/52 B |
| 4,140,267 | 2/1979 | Scott et al. | 229/52 B |

*Primary Examiner*—Herbert F. Ross

*Attorney, Agent, or Firm*—Guy A. Greenawalt

[57] ABSTRACT

An end closure arrangement for a paperboard carton includes a carrying handle construction in which a pair of handle forming panels are cut from overlapping end closure panels and strengthened by supplemental reinforcing panels which are cut from dust flaps underlying the closure panels and which are secured between the handle forming panels, with the latter adapted to hinge to upstanding relation relative to the closure panels for carrying the carton.

8 Claims, 7 Drawing Figures

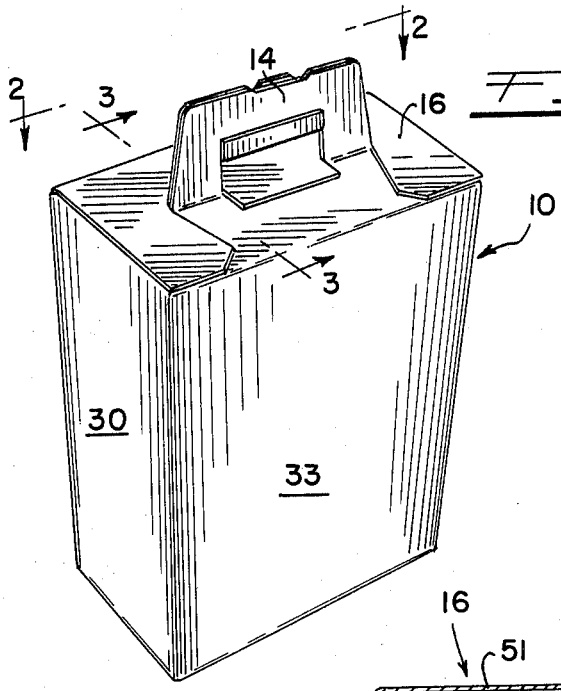
FIG. 1
FIG. 3
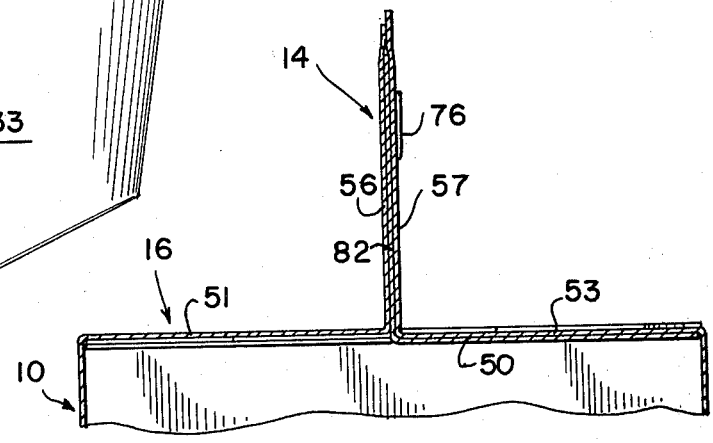
FIG. 2
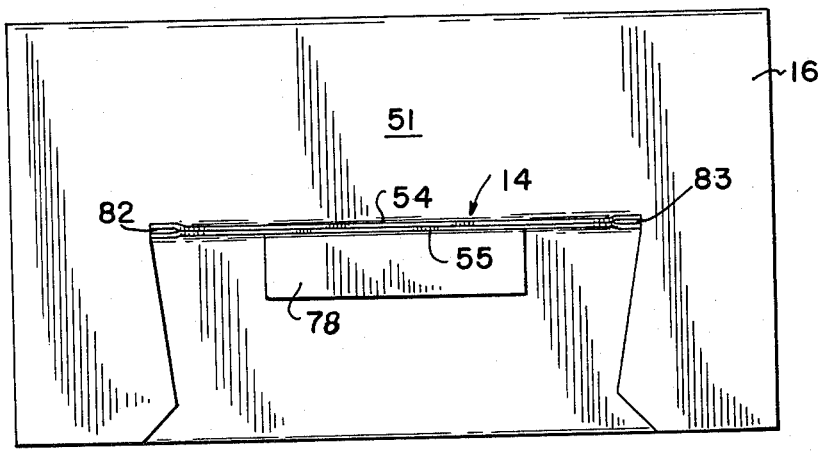

CARTON END CLOSURE WITH INTEGRAL HANDLE

BACKGROUND OF THE INVENTION

This invention relates to carton construction and is more particularly concerned with improvements in carton end closures which incorporate an integral carrying handle construction.

Relatively large size carton structures which are formed from cut and scored blanks of foldable sheet material, such as, paperboard, have been provided heretofore which have included a handle arrangement for carrying the same. A carrying handle is particularly desirable where the carton is employed in the marketing of a relatively large quantity of a product having substantial weight, such as, for example, soap powders and detergents, commonly marketed in so called economy size or jumbo packages which are too large and heavy to be conveniently handled by a purchaser when not provided with some type of carrying means. Most prior handle designs which have been provided for such packages either lack sufficient strength to avoid tearing during handling or the cost of providing the handle structure is considered too great in a highly competitive package manufacturing field. Consequently, there is a need for a more rugged handle structure which can be incorporated in the carton with maximum economy of material and with minimum labor.

A general object of the present invention is to provide an improved carton which may be formed of foldable paperboard, or similar sheet material, and which includes an end closure structure having an integral carrying handle of rugged construction.

A more specific object of the invention is to provide an improved carton construction for packaging products which includes top end closure panels having an integral carrying handle structure which is adapted to be hinged between a flattened position in the plane of the end closure panels and an upright carrying position.

A still more specific object of the invention is to provide a carton structure which is particularly adapted for packaging a product of relatively large volume and substantial weight wherein an integral carrying handle is formed in the top end closure panels which handle is collapsible into the plane of the end closure panels and which is reinforced so as to minimize the risk of tearing when employed in lifting the carton.

A further object of the invention is to provide an improved carton of the type described wherein top end closure panels are cut and scored to provide a double panel handle structure comprising reinforcing panels which are hinged to the innermost closure panels and secured to the double panel handle structure.

The invention as claimed herein comprises a tubular carton structure formed of foldable sheet material which includes top end closure panels hinged to the top edges of the side wall panels and foldable into end closing relation with an integral multi-panel handle structure in which the handle panels are derived from the top end closure panels and secured together so as to be connected to the innermost end closure panels.

The foregoing and other objects and advantages of the invention will become more apparent from a consideration of the accompanying description of the preferred form thereof which is set forth therein by way of example and shown in the accompanying drawings wherein like reference numerals indicate corresponding parts throughout.

BRIEF DESCRIPTION OF THE DRAWINGS

FIG. 1 is a perspective view of a carton provided with a top end closure and handle construction which incorporates the principle features of the invention;

FIG. 2 is a plan view taken on line 2—2 of FIG. 1 to an enlarged scale, and showing the top of the carton of FIG. 1 with the handle structure in upstanding position for carrying the carton;

FIG. 3 is a cross-sectional view taken on the line 3—3 of FIG. 1, to an enlarged scale;

DESCRIPTION OF THE PREFERRED EMBODIMENT OF THE INVENTION

Figure 7:
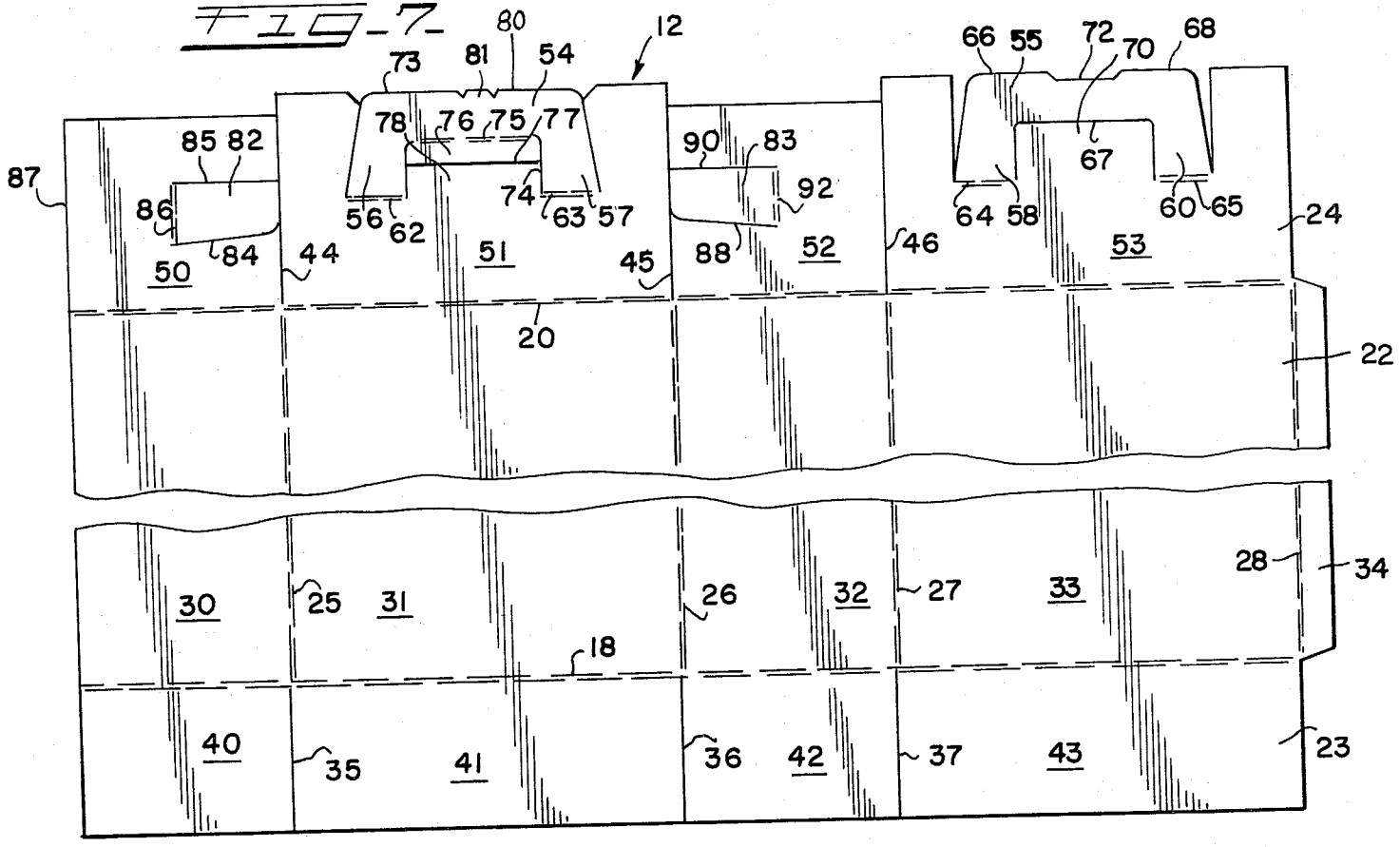
FIG. 7 is a plan view, with portions broken away showing a cut and scored blank employed in forming the carton of FIG. 1.

Referring to the drawings, there is illustrated a preferred form of a package forming carton 10 (FIG. 1) and a blank 12 (FIG. 7) of paperboard, or similar foldable sheet material, of suitable weight or gauge, which blank is cut and scored so as to provide the desired panels for forming the carton 10. The carton 10, which is illustrated, is particularly useful in packaging relatively large quantities of a product which is in granular or powder form, such as, soap powder, or detergent. It includes a carrying handle 14 which is incorporated in the top end closure structure 16 in such manner that it may be swung between a position in the plane of the closure 16 and upright carrying position.

The blank 12, which is generally rectangluar, is divided by longitudinally extending, transversely spaced hinge score, or crease, lines 18 and 20, into a center section 22, which is adapted to be subdivided into body forming panels, and lateral side sections 23 and 24, which are adapted to be subdivided, so as to form, bottom and top closure panel elements.

The center section 22 of the blank 12 is divided by longitudinally spaced transversely extending parallel hinge score lines 25, 26, 27 and 28 into rectangular body sidewall forming panels 30, 31, 32, 33 and a connecting glue panel 34. Panels 31 and 33 have a dimension in the lengthwise direction of the blank which is substantially larger than the corresponding dimension of the panels 30 and 32. The glue panel 34 at the one end of the blank is narrow and provides a means for connecting the margins of panels 30 and 33 when the blank is folded into a tube with a rectangular cross-section. At the one side of the blank, the section 23 thereof is subdivided by cutting on the lines 35, 36 and 37, which constitute extensions of the dividing lines 25, 26 and 27 in the center section 22 of the blank, so as to form the bottom panels 40, 41, 42 and 43. The panels 41 and 43 are adapted to serve as bottom closure panels and the panels 40 and 42 are adapted to serve as dust flaps which cooperate with the panels 41 and 43 in closing the bottom end of the set-up carton. At the opposite side of the blank 12, the section 24 is subdivided by cutting on the lines 44, 45 and 46, which constitute extensions of the lines 25, 26 and 27, so as to form panels 50, 51, 52 and 53. The panels 51 and 53 have a lateral dimension corresponding approximately to the dimension of the panels 30 and 32 in the longitudinal direction of the blank 12 so as to close the top end of the tubular carton when folded into overlying relation over the same. The panels 50 and 52 have a dimension laterally of the blank 12 which is approximately one-half the dimension of the sidewall panels 31 and 33 in the longitudinal direction of the blank.

The panels 51, 53 and 50, 52 are cut to provide the elements desired for forming the handle structure 14 (FIG. 1). The handle forming panels 54 and 55, which have an identical U-shaped configuration, as shown, may have a different configuration but the U-shape is preferred. They are cut in the outer margins of the panels 51 and 53 with the leg forming portions 56, 57 and 58, 60 terminating on hinge score lines 62, 63 and 64, 65 which are in alignment longitudinally of the blank and centered relative to the transverse dimension of the panels 51 and 53 so that when the closure panels 51 and 53 are folded into end closing relation, the handle panels 54 and 55 may be brought into face to face engagement and secured for hinging as a unit on the lines 62, 64 and 63, 65. The one handle panel 55, which is derived from the inside closure forming panel 53, is defined by the outer, perimeter forming, U-shaped cutting line 66, and the inner U-shaped cutting line 67. These lines are spaced apart a distance, in the form shown, which is approximately one-half the distance between the hingescore lines 64, 65 and the terminal side edge 68 of the panel. This leaves an integral extension 70 of the central portion of the panel 53 between the leg portions of the panel 55. The outer edge 68 of the panel 55 is notched out at 72. The other handle panel 54, which is derived from the outside closure panel 51, is defined by an outer, perimeter forming, U-shaped cutting line 73 and an inner, U-shaped, partly cut and partly scored line 74, with the base portion 75 of the latter being scored so as to form a hinge for a narrow tab-like panel 76 which results from cutting on the line 77. The cutting line 77 extends between the two cutting line portions which define the inside edges of the legs 56, 57 of the U-shaped handle panel 54 and is located in the space between the score line 75 and the score lines 62, 63 at a point which leaves an integral portion 78 extending outboard of the inner half of the panel 51 between the legs 56, 57 of the panel 54. The outer terminal edge 80 of the panel 54 has two spaced v-shaped notches which define a small tab portion 81 in the center of the edge 80 for registering with notch 72 in panel 55.

The panels 50 and 52, which provide dust flaps forming the innermost panels of the multipanel top end closure structure 16 are cut so as to provide load bearing and reinforcing panel elements 82 and 83 for the handle structure 14. The panel 82 is defined by transversely spaced longitudinally extending cutting lines 84, 85, which extend from the transverse cutting line 44 and transversely extending score line 86. The cutting lines 84, 85 extend from the transverse cutting line 44 approximately half the distance to the terminal end edge 87 of the panel 50 and the blank 12. The cutting and score lines result in a configuration corresponding to the configuration of a major portion of the one leg section 56 of the U-shaped handle panel 54, which is adjacent the cutting line 44, and the corresponding leg section 60 of the other handle panel 55, which is secured to the leg section 56 in forming the handle. The reinforcing panel element 82 is located in the panel 50 a predetermined distance from the longitudinal hinge score line 20 so that when the end closure panels are folded and secured, the hinge score line 86 will register with the hinge score lines 62 and 65 of the handle panels 54 and 55 which enables the panel 82 to be secured between the leg portions 56 and 60 of the handle panels. The reinforcing panel 83 is cut on the transversely spaced lines 88 and 90 which extend longitudinally from the transverse cutting line 45 in the direction of the other end of the blank 12 with their terminal ends connected by the transverse score line 92 which provides a configuration the same as panel 82 and the panel 83 is located in the panel 52 so that the hinge score line 92 registers with the hinge score lines 63 and 64 of handle panels 54 and 55. This enables the panel 82 to be secured between the leg portions 57 and 58 of the handle panels 54 and 55.

Figure 4:
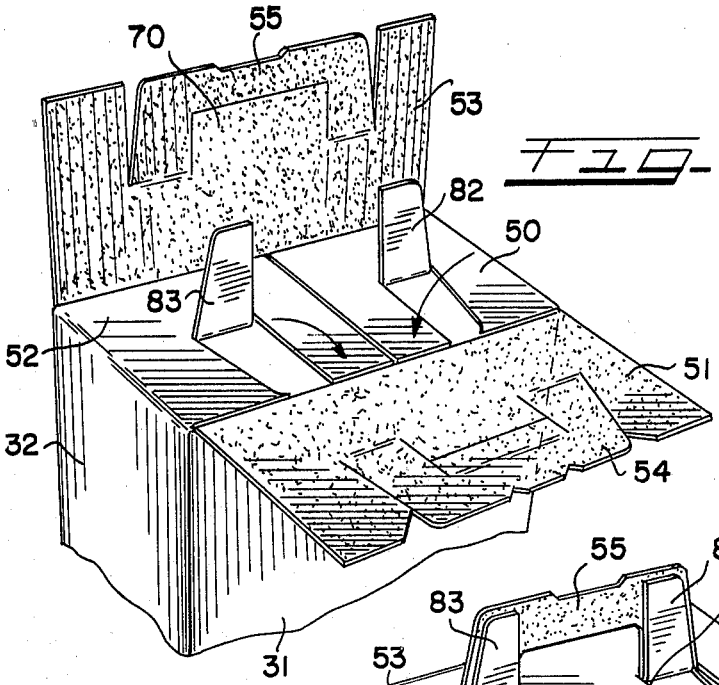
FIG. 4 is a perspective view of the top portion of the carton illustrating the initial steps in forming the top end closure.
Figure 5:
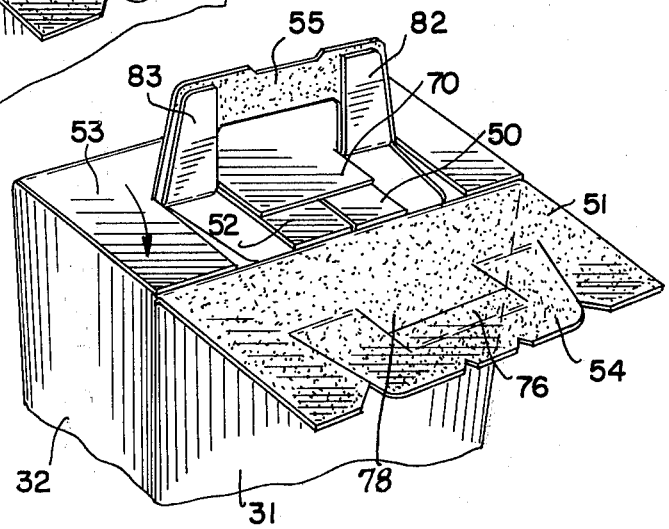
FIG. 5 is a perspective view of the top portion of the carton illustrating further steps in forming the top end closure.
Figure 6:
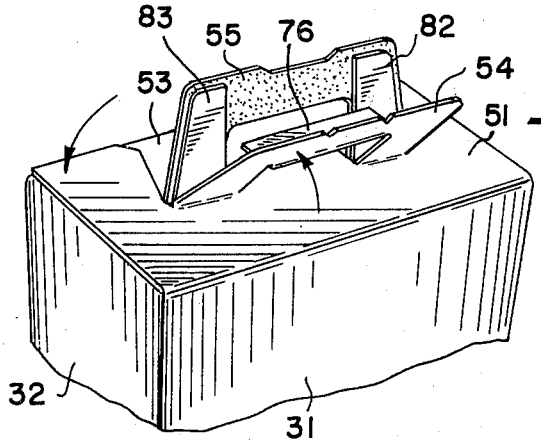
FIG. 6 is a perspective view of the top portion of the carton illustrating still further steps in forming the top end closure.

In assembling the carton end panels, following the folding and securing of the body forming panels 30, 31, 32 and 33, and setting up the same into tubular form, the top end closure and handle panel elements may be folded and connected as illustrated in FIGS. 4, 5, and 6. An adhesive is applied to the innermost faces of the closure panels 51 and 53 and the dust flap forming panels 50 and 52 are folded inwardly into the end closing position shown in FIG. 4 with the handle reinforcing panel elements 82 and 83 being brought into upstanding relation relative to the panels 50 and 52. The innermost closure panel 53 may then be folded into overlying relation with the panels 50 and 52 while the handle panel 55 is hinged to upright position so as to position the handle reinforcing panels in face engagement with the leg forming portions 58, 60 of the handle panel 55. The extension panel portion 70 overlies marginal portions of panels 50 and 52 so as to aid in securing together the underlying dust panels 50 and 52. Finally, the outer closure panel 51 is folded into overlying relation with the panel 53 while the handle panel 54 is hinged into face engagement with the handle panel 55 so as to trap the reinforcing panel or tab elements 82 and 83 between the leg portions of the handle panels.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carring out this invention, but that the invention will include all embodiments falling within the scope of the appended claims.

What is claimed is:

1. In a carton formed of foldable sheet material which is divided into wall panels and connected into a tubular formation, an end closure structure which comprises a pair of innermost closure panels extending inwardly from the top edges of oppositely disposed sidewall panels and a pair of outer closure panels extending inwardly from oppositely disposed adjoining sidewall panels in overlying relation with each other, said end closure structure including a multi-panel handle forming structure which is derived by cutting and folding into face engaging relation generally U-shaped handle forming portions of said outer closure panels and positioning therebetween a handle reinforcing means extending outward from each of the innermost closure panels and secured betwen said U-shaped handle forming portions.

2. In a carton as set forth in claim 1 wherein said U-shaped handle forming portions are cut from the outermost margins of said closure panels so as to position the innermost edges of said U-shaped handle forming portions for alignment when said closure panels are folded into overlying relation and said U-shaped handle forming portions are hinged about said innermost edges into face engaging relation.

3. In a carton as set forth in claim 2 wherein said handle reinforcing means comprises one or more panel portions cut from said innermost panels comprising said end closure structure.

4. In a carton as set forth in claim 1 wherein said multi-panel handle structure is disposed in the center of said end closure structure and is hingedly joined to said closure panels so that it may be folded into the plane of said outer end closure panels.

5. In a carton as set forth in claim 1 wherein said innermost panels are co-planar.

6. In a carton as set forth in claim 2 wherein one of said U-shaped handle forming portions includes locking tab means for engaging another U-shaped handle forming portion when positioned into face engaging relation.

7. In a carton formed of foldable sheet material which is divided into wall panels and connected into a tubular formation, an end closure structure which comprises innermost panels extending inwardly from the top edges of oppositely disposed sidewall panels and outer closure panels extending inwardly from oppositely disposed adjoining sidewall panels, said end closure structure including a multi-panel handle forming structure which is derived by cutting and folding into face engaging relation generally U-shaped portions of said closure panels and a handle panel reinforcing means extending from the inner face of the innermost one of said closure panels and secured to said U-shaped panel portions said handle panel reinforcing means comprising tab formations integrally hinged to said innermost panels of said end closure structure and secured between innermost portions of said U-shaped handle forming panel portions.

8. In a carton formed of foldable sheet material which is divided into wall panels and connected into a tubular formation, an end closure structure which comprises innermost panels extending inwardly from the top edges of oppositely disposed sidewall panels and outer closure panels extending inwardly from oppositely disposed adjoining sidewall panels, said end closure structure including a multi-panel handle forming structure which is derived by cutting and folding into face engaging relation generally U-shaped portions of said closure panels and a handle panel reinforcing means extending from the inner face of the innermost one of said closure panels and secured to said U-shaped panel portions, said outer closure panels are cut so as to leave said panels with outer marginal portions extending between leg forming portions of said U-shaped handle forming panel portions which are overlapped and secured together.

* * * * *

UNITED STATES PATENT AND TRADEMARK OFFICE

CERTIFICATE OF CORRECTION

PATENT NO. : 4,308,995

DATED : January 5, 1982

INVENTOR(S) : Harry R. Hanes

It is certified that error appears in the above-identified patent and that said Letters Patent are hereby corrected as shown below:

Column 4, line 19, delete "82" and insert -- 83 --.

Signed and Sealed this

*Fifteenth* Day of *June 1982*

[SEAL]

*Attest:*

GERALD J. MOSSINGHOFF

*Attesting Officer*

*Commissioner of Patents and Trademarks*